US008764617B2

(12) United States Patent
Teeter

(10) Patent No.: US 8,764,617 B2
(45) Date of Patent: Jul. 1, 2014

(54) BACK STRETCHING DEVICE

(76) Inventor: Roger C. Teeter, Puyallup, WA (US)

( * ) Notice: Subject to any disclaimer, the term of this patent is extended or adjusted under 35 U.S.C. 154(b) by 295 days.

(21) Appl. No.: 13/190,481

(22) Filed: Jul. 26, 2011

(65) Prior Publication Data

US 2013/0029812 A1 Jan. 31, 2013

(51) Int. Cl.
*A63B 21/02* (2006.01)
*A63B 26/00* (2006.01)

(52) U.S. Cl.
USPC ..... 482/126; 482/140

(58) Field of Classification Search
CPC ..... A61H 1/0292; A61H 2201/1284; A61H 2201/1623; A61H 2201/168; A61H 2203/0431; A63B 23/0233; A63B 23/0238
USPC ..... 482/51, 92, 121, 126, 139–140, 482/142–144, 907–908, 91, 124, 131
See application file for complete search history.

(56) References Cited

U.S. PATENT DOCUMENTS 5,441,473 A * 8/1995 Safani et al. ..... 482/130
5,720,702 A * 2/1998 Lee ..... 482/129
5,728,035 A * 3/1998 Sands ..... 482/140
5,772,563 A * 6/1998 Lin ..... 482/140
5,776,042 A * 7/1998 Szabo ..... 482/140
5,779,607 A * 7/1998 Harris ..... 482/140
5,816,985 A * 10/1998 Ho ..... 482/140
5,941,806 A * 8/1999 Olschansky et al. ..... 482/140
6,090,023 A * 7/2000 Liu ..... 482/140
6,220,995 B1 * 4/2001 Chen ..... 482/140
7,341,547 B2 * 3/2008 Liao ..... 482/140
7,442,153 B1 * 10/2008 Chasnov ..... 482/142
8,002,683 B1 * 8/2011 Nayebdadash ..... 482/140
2007/0281840 A1 * 12/2007 Tsai ..... 482/140
2008/0182730 A1 * 7/2008 Conley et al. ..... 482/95

* cited by examiner

*Primary Examiner* — Loan H Thanh
*Assistant Examiner* — Gregory Winter
(74) *Attorney, Agent, or Firm* — Leong C. Lei

(57) ABSTRACT

A back stretching device includes a handle unit including two parallel handgrip units. A support unit includes a lower cross bar connecting between front ends of the two handgrip tubes. A hold-down unit includes two parallel guide rods and an upper cross bar connecting between upper ends of the guide rods and parallel to the lower cross bar. The adjustment unit couples the guide rods to the handgrip tubes to define a distance-adjustable constraint space between the upper and lower cross bars. The constraint space receives the legs of a user to extend therethrough in a closely juxtaposed manner with the lower cross bar supporting the underside of the legs and with the upper cross bar constraining the upper side of the legs. The hands of the user are allowed to hold the two handgrip tubes to support the legs and body of the user for carrying out a desired stretching and exercise operation.

9 Claims, 9 Drawing Sheets

BACK STRETCHING DEVICE

(A) TECHNICAL FIELD OF THE INVENTION

The present invention generally relates to a back stretching device that is of a simplified structure and capable of stretching the middle and lower back including the sacrum.

(B) DESCRIPTION OF THE PRIOR ART

Back stretching devices that are currently available in the market can be roughly categorized to the following two types:

(1) Inversion Tables and similar devices where the user is inverted utilizing body weight to stretch muscles and decompress the joints.

(2) Horizontal traction devices where the user is mechanically stretched and decompressed using a force applied by machine or via a body harness connected by a line over a pulley to a weight.

Both of these two kinds of devices offer traction in two different body positions, straight (either supine or prone) or in a 90/90 position with hips and knees at 90 degrees. For example Teeter Hang ups offers inversion tables where the body is supine clamped by the ankles or alternately the DEX where the body is at a 90/90 position. One problem with all of these devices is that they are expensive and not portable. It is desired to provide a simple and portable traction device where the user from a 90/90 position is able to apply the decompression force using their arms and shoulders and which therefore does not require inversion or weights.

SUMMARY OF THE INVENTION

The primary purpose of the present invention is to provide a back stretching device, which is a portable, simple decompression device that puts the user in a 90/90 position, where the knees are at or about 90 degrees and the hips are at or about 90 degrees.

When a person is in a 90/90 position, the psoas muscle is relaxed and the normal curvature in the lower back is flattened. With the lower back curvature flattened, more intervertebral separation can be realized in the lower back area when traction is applied than if the body is straight. When the spine is decompressed there are many ways in which back pain is relieved: for example (1) taking pressure off a sore joint or pinched nerve; (2) helping discs to hydrate by picking up moisture from surrounding tissue and becoming thicker; (3) decompressing misaligned joints to make them reach at or near zero pressure thereby helping the misaligned joints to naturally realign (the joints of the back are surrounded by ligaments and muscles which stabilize the joints but also hold them in background compression even when lying horizontally supine or prone with a force equal to about 25% of the pressure that joint sees when a person is standing; this background compression tends to hold a joint in any misalignment caused by over use or miss use); and (4) allowing the muscles surrounding the joint to be stretched and relaxed. Additionally ligaments connecting the vertebrae are loaded which helps them to be more supple and therefore less easily torn.

Accordingly, the primary value of the invention is to relieve back pain more comprehensively for the lower back than the known devices that apply traction with the body straight and more conveniently than the non portable inversion devices that put the user in a 90/90 position. The invention also helps stretch back muscles and relaxes ligaments. The area of the back benefited is the thoracic, lower back and sacrum.

To achieve the object, the present invention provides a back stretching device, which is composed of the following constituent components:

a handle unit, which has two parallel handgrip tubes;

a support unit, which comprises a lower cross bar connecting between front ends of the two handgrip tubes;

a hold-down unit, which comprises two parallel guide rods and an upper cross bar connecting between upper ends of the guide rods, the upper cross bar being substantially parallel to the lower cross bar; and an adjustment unit, which couples the two guide rods to the two handgrip tubes to define a distance-adjustable constraint space between the upper cross bar and the lower cross bar, whereby the constraint space is sufficient to receive legs of a user to extend therethrough in a closely juxtaposed manner with the lower cross bar supporting underside of the legs, while the upper cross bar constraining upper side of the legs, hands of the user being allowed to hold the two handgrip tubes to support the legs and body of the user in a 90/90 position, whereby a stretching operation that stretches and relaxes the upper and lower back of the user can be performed. As such, the present invention realizes a combination of the conventional back stretching devices of upward stretching back type and downward stretching back type as an integrated device with a simplified structure.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
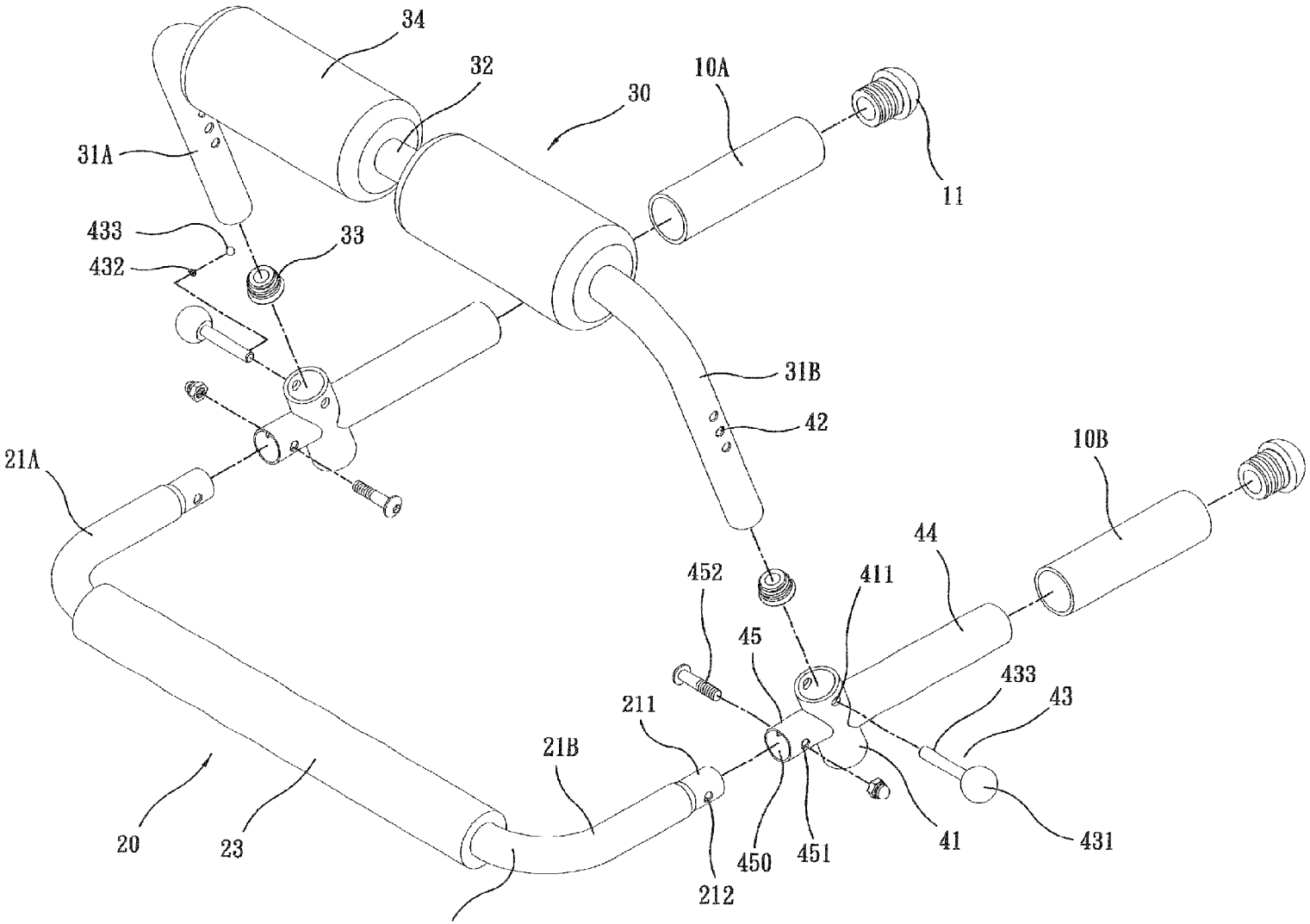
FIG. 1 is an exploded view showing an embodiment according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3A, and 3B, the present invention provides a back stretching device that is composed of the following constituent components:

A handle unit has two parallel handgrip tubes 10A, 10B. The two handgrip tubes 10A, 10B each have opposite front and rear ends. A plastic-made plug 11 is mounted to the rear end.

A support unit has two parallel connection bars 21A, 21B. The two connection bars 21A, 21B each have opposite front and rear ends. A lower cross bar 22 is connected between the front ends, whereby the two connection bars 21A, 21B and the lower cross bar 22 collectively form a U-shaped lower bar assembly 20. A cushioning collar 23 made of foamed materials surrounds an outer circumference of the lower cross bar 22. The two connection bars 21A, 21B each form a diameter-reduced neck section 211 at the rear end. A first assembling hole 212 is formed diametrically through the neck section 211.

A hold-down unit comprises two parallel hollow guide rods 31A, 31B. The two guide rods 31A, 31B each have opposite upper and lower ends. An upper cross bar 32 is connected between the upper ends of the two guide rods 31A, 31B, whereby the upper cross bar 32 and the two guide rods 31A, 31B collectively form a U-shaped upper bar assembly 30. The upper cross bar 32 is arranged above and substantially parallel to the lower cross bar 22. The two guide rods 31A, 31B each comprises a plastic-made plug 33 mounted to the lower end thereof. Two pressures relief collars 34 made of foamed materials are arranged to surround an outer circumference of the upper cross bar 32.

Figure 3A:
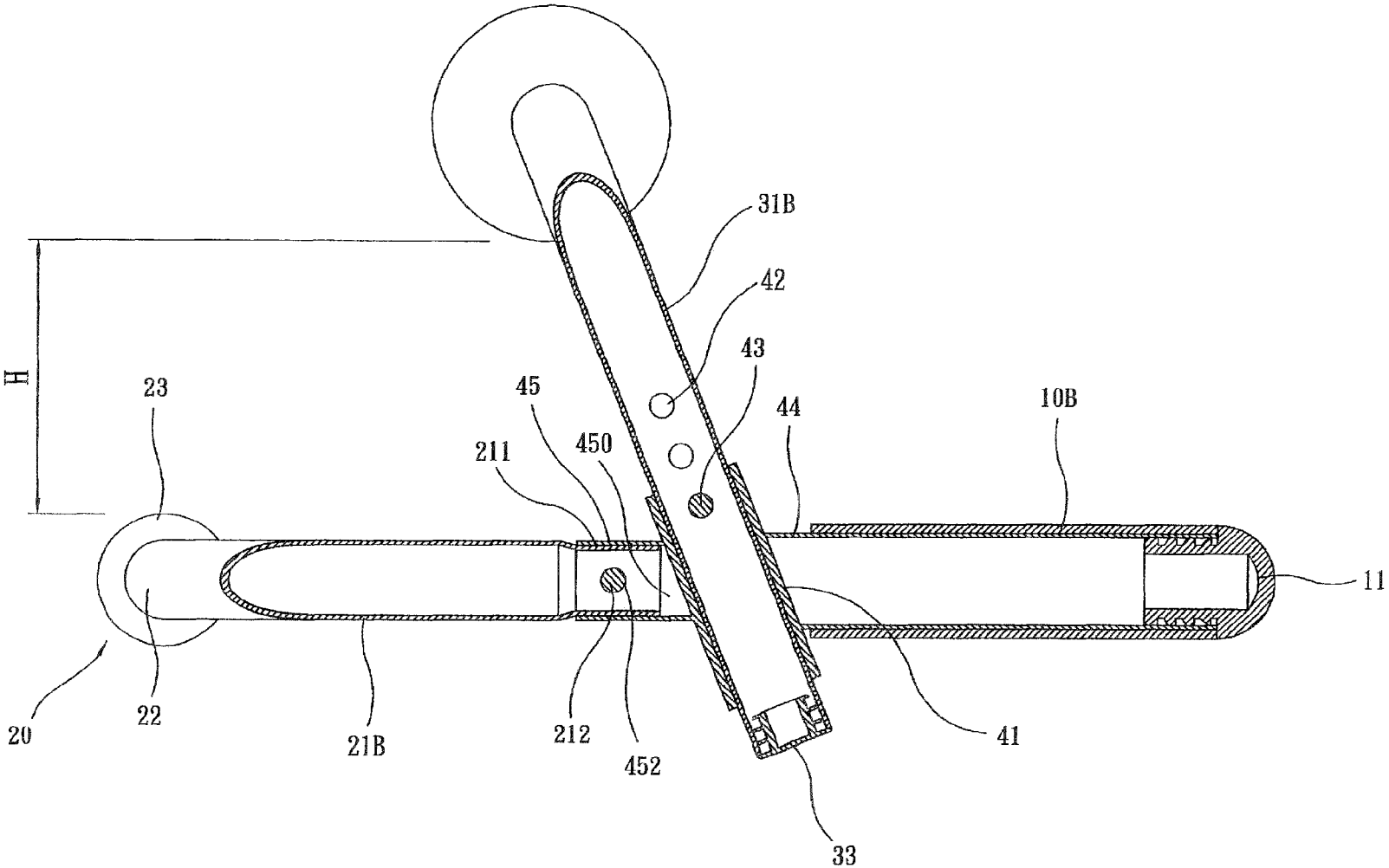
FIGS. 3A and 3B are schematic view demonstrating an operation of adjusting a constraint space according to the present invention.
Figure 3B:
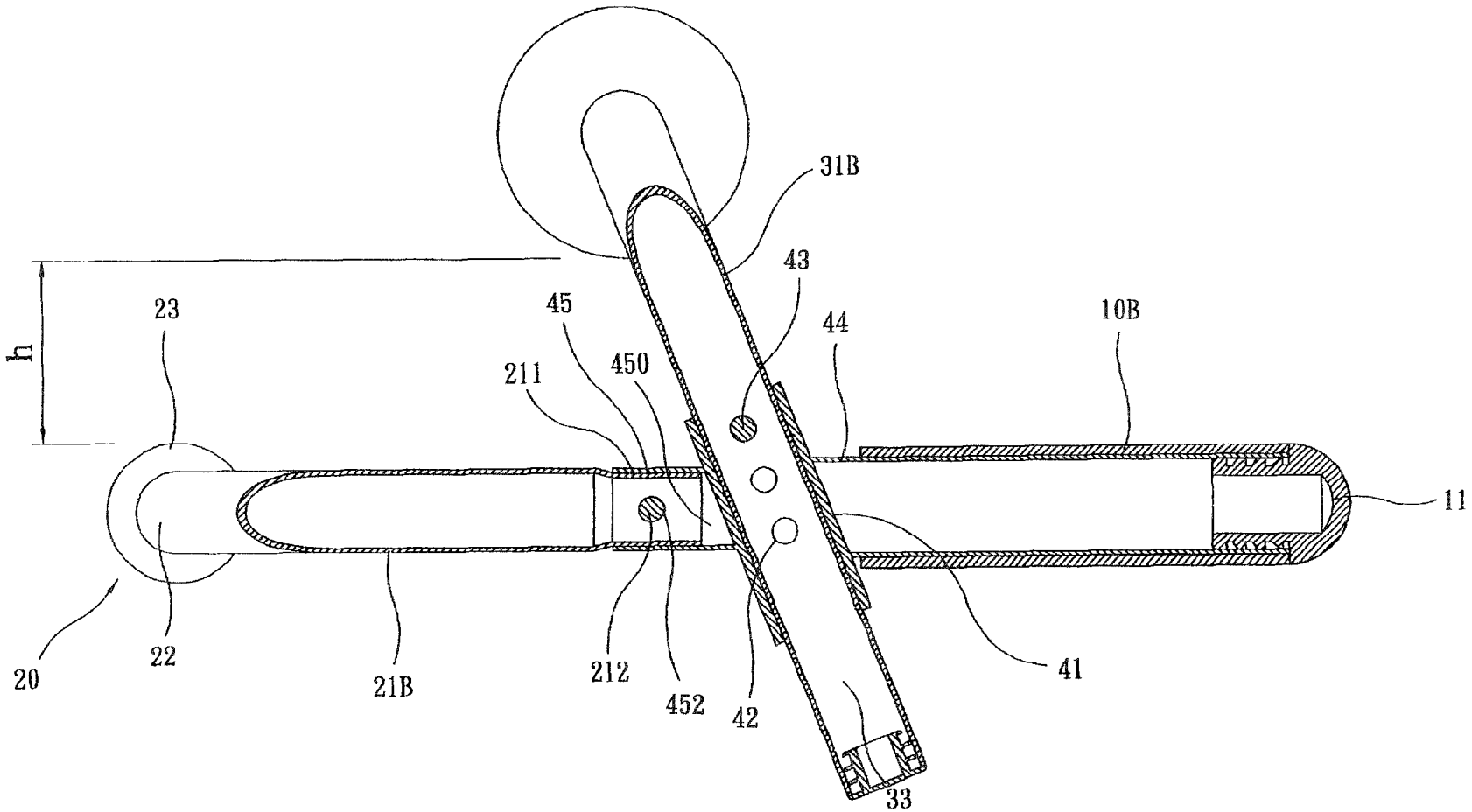
Figure 4:
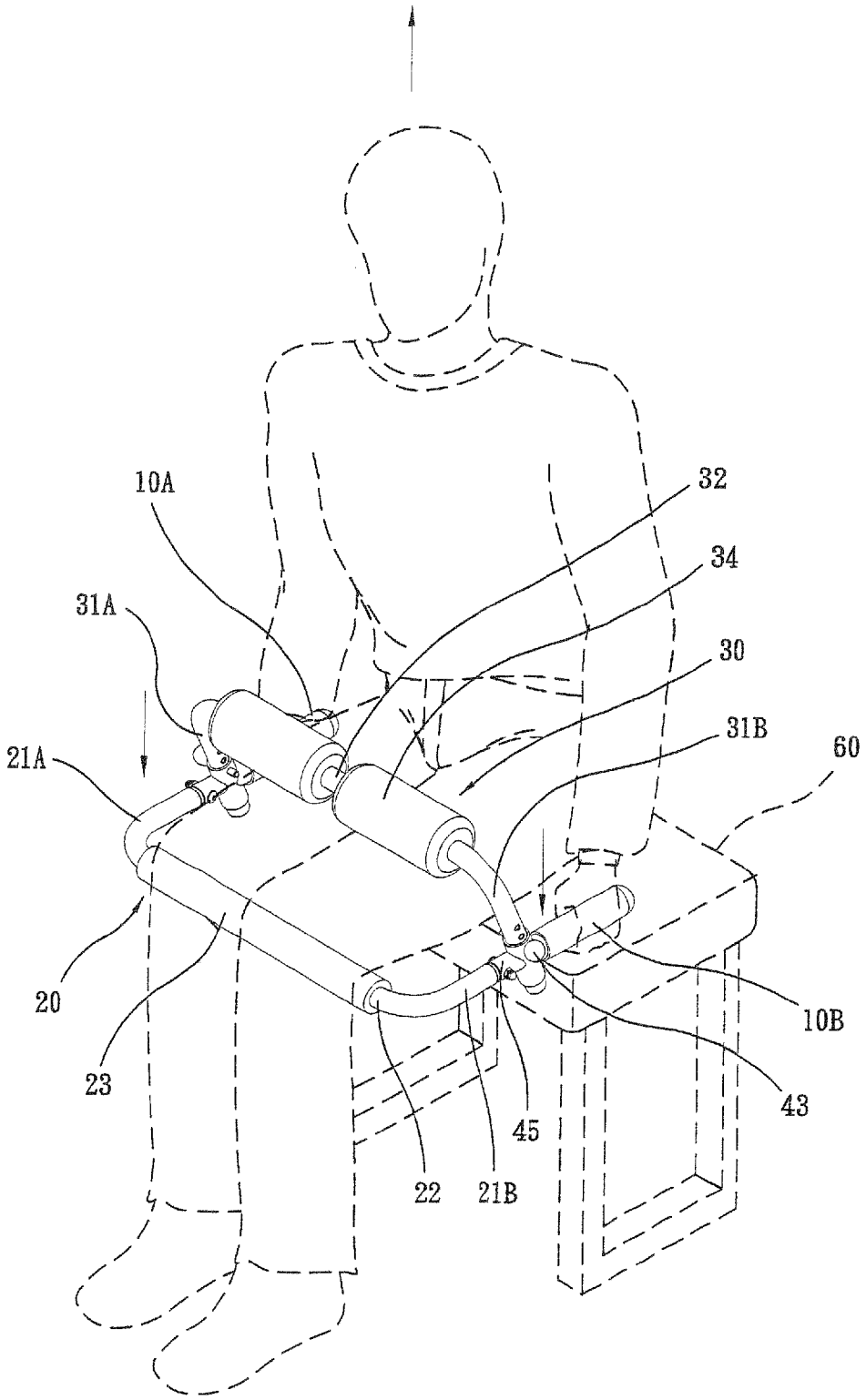
FIG. 4 is a perspective view showing a first operation of use of the embodiment according to the present invention.
Figure 5:
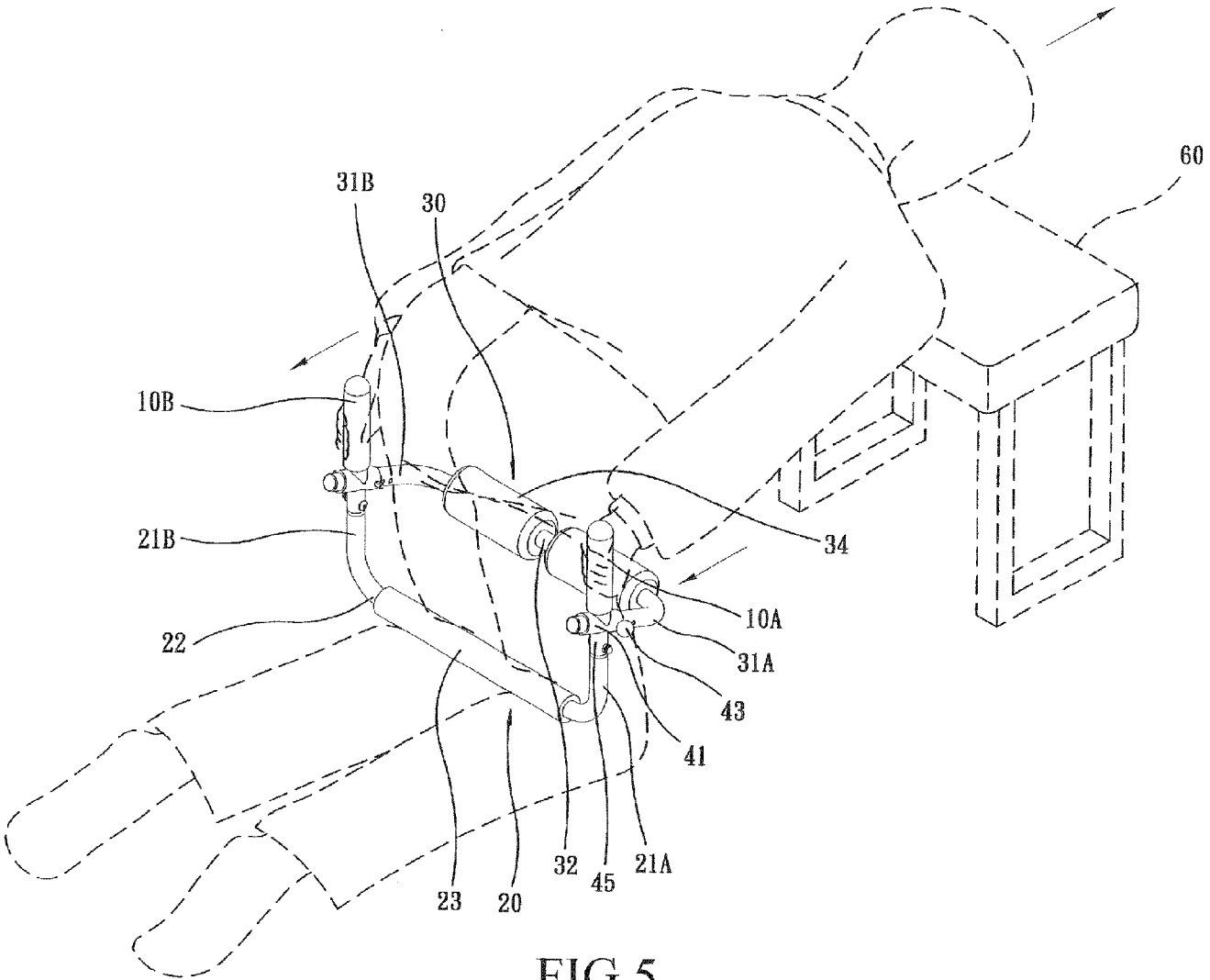
FIG. 5 is a perspective view showing a second operation of use of the embodiment according to the present invention.
Figure 6:
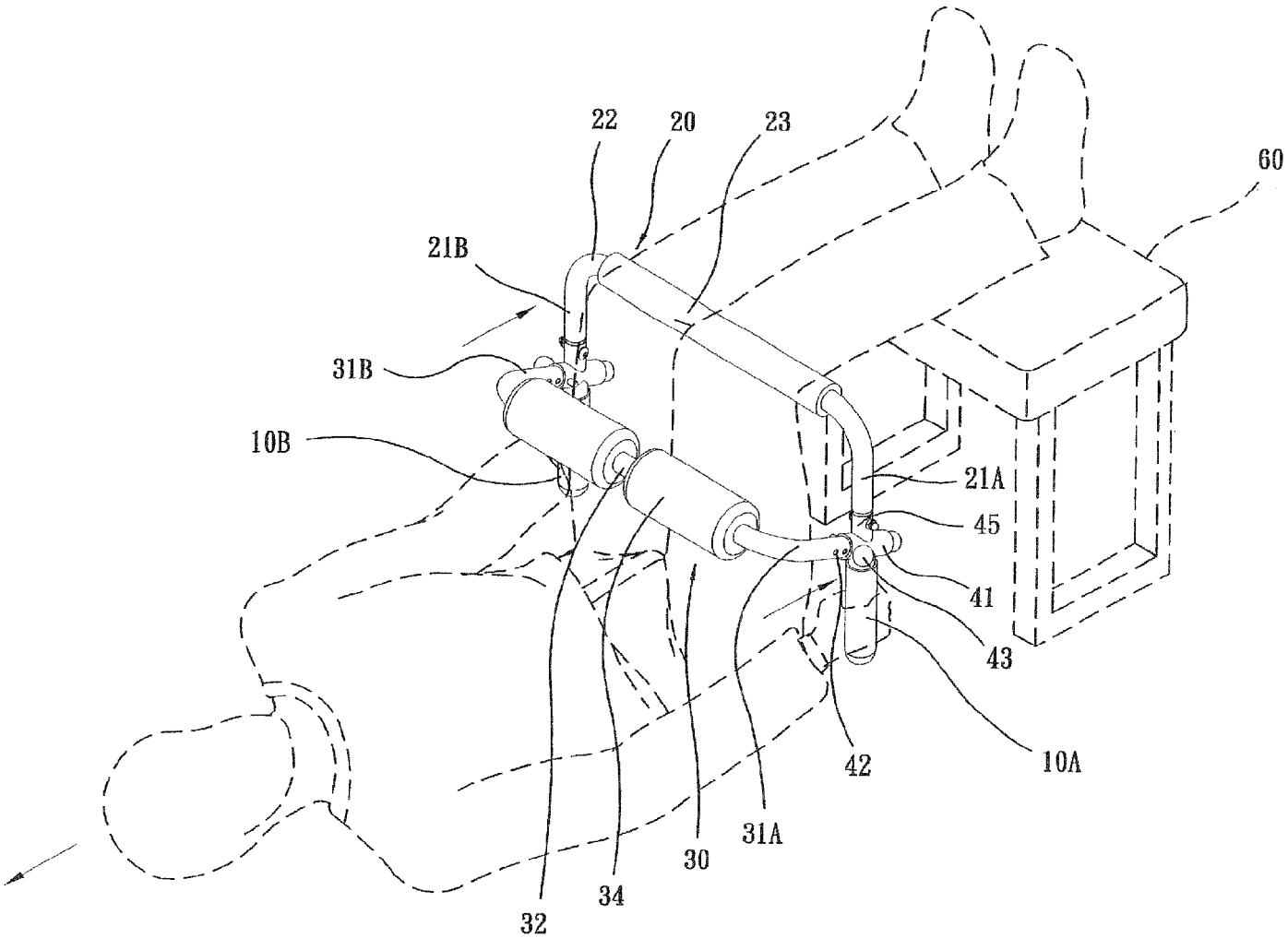
FIG. 6 is a perspective view showing a third operation of use of the embodiment according to the present invention.

An adjustment unit comprises two sleeves 41. The two sleeves 41 respectively receive the two guide rods 31A, 31B to slide therein for coupling. The two guide rods 31A, 31B each form a series of adjustment holes 42 extending therethrough at different altitudes. The sleeves 41 each form a positioning hole 411 corresponding to the adjustment holes 42. A pin 43 is removably fit into each positioning hole 411 and a respective one of the adjustment holes 42 to secure the guide rod 31A, 31B to the respective sleeve 41. To prevent undesired separation of the pin 43 from the adjustment hole 42 and the positioning hole 41, the pin 43 comprises a diametrically expanded pull knob 431 formed at an end thereof projecting outside the sleeve 41 and provided at an opposite end of the pin 43 is a ball 433 biased by a spring 432 to project beyond a surface of the pin 43 for constraining and thus preventing the pin 43 from easily falling off the adjustment holes 42 and the positioning hole 411. With a sufficient force applied, the ball 433 can only be forced to retract for passing through the adjustment holes 42 and the positioning hole 411. The two sleeves 41 each comprise an insertion tube 44 extending from an outer circumference thereof for insertion into the respective handgrip tube 10A, 10B and also comprise a joint tube 45 extending from the outer circumference thereof for receiving the respective connection bar 21A, 21B to insert therein. The joint tube 45 forms a second assembling hole 451 corresponding to the first assembling hole 212. A fastener set 452 is receivable through the first and second assembling holes 212, 451 to connect the lower cross bar 22 between the front ends of the two handgrip tubes 10A, 10B, whereby as shown in FIGS. 3A and 3B, with the pins 43 being selectively put into adjustment holes 42 at different altitudes, an adjustable distance (H), (h) is defined between the upper cross bar 32 and the lower cross bar 22 to form a constraint space 50. Also referring to FIGS. 4, 5, and 6, the constraint space 50 is sufficient to receive legs of a user to extend therethrough in a closely juxtaposed manner with the cushioning collar 23 of the lower cross bar 22 supporting the underside of the legs and the pressure relief collars 34 holding down the upper side of the legs. With the assistance of a chair 60, the hands of the user may hold the two handgrip tubes 10A, 10B to support the legs and body of the user in a 90/90 position, whereby a stretching exercise that stretches the user's back upward is generated between the two handgrips 10A, 10B and the user's hands, while the constraint space 50 induces a stretching exercise that stretches the user's back downward. As such, the present invention allows of complete stretching of the whole back of the user.

It is noted that in an embodiment of the present invention, as shown in FIGS. 3A and 3B, the two U-shaped bar assemblies 20, 30 are set at an angle to each other. However, the angle between the U-shaped upper and lower bar assemblies 20, 30 is not critical. The U-shaped bar assemblies 20, 30 may be at an angle of for example 90 degrees to each other or some other angle to that shown.

Figure 2:
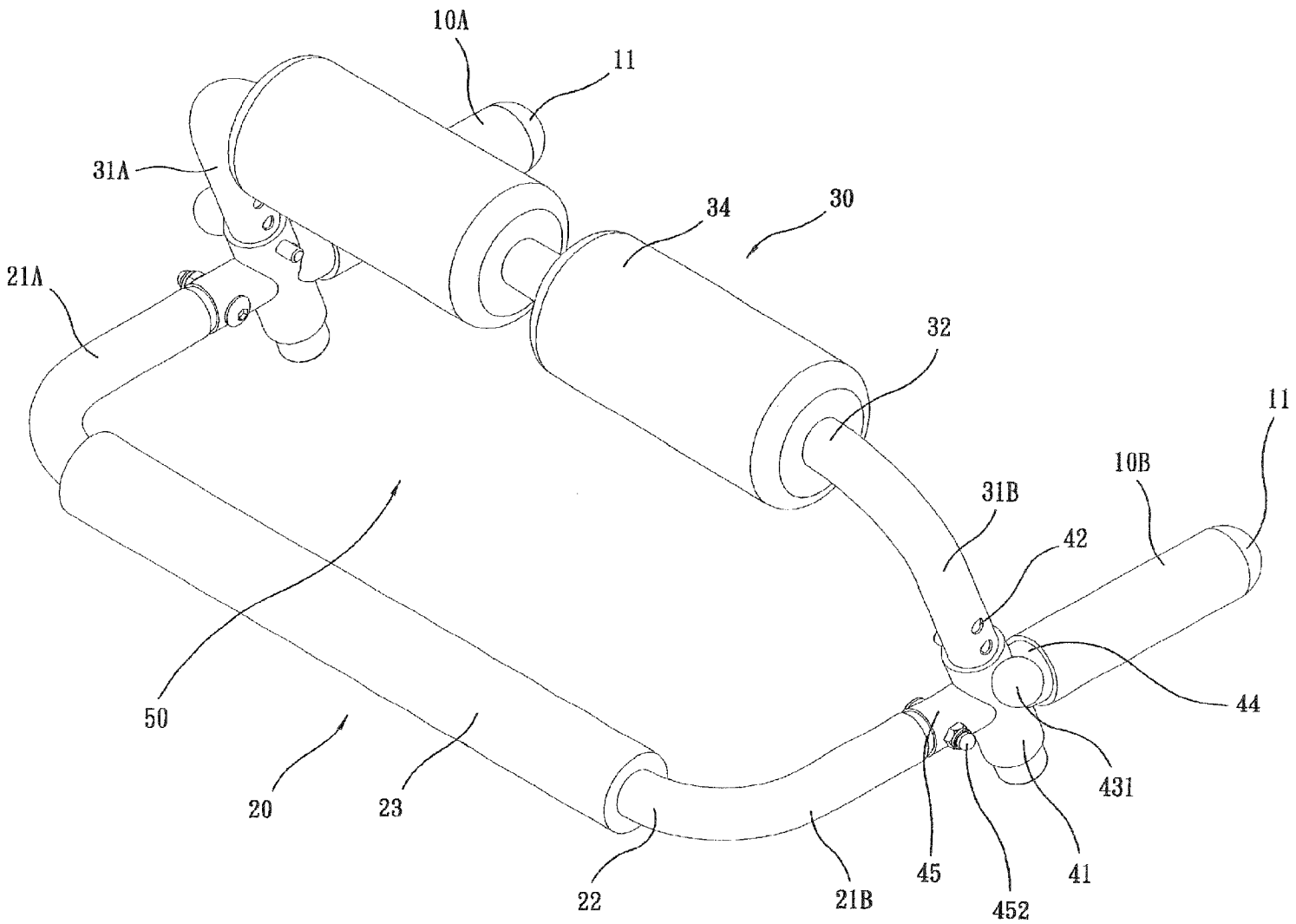
FIG. 2 is a perspective view of the embodiment according to the present invention in an assembled form.
Figure 7:
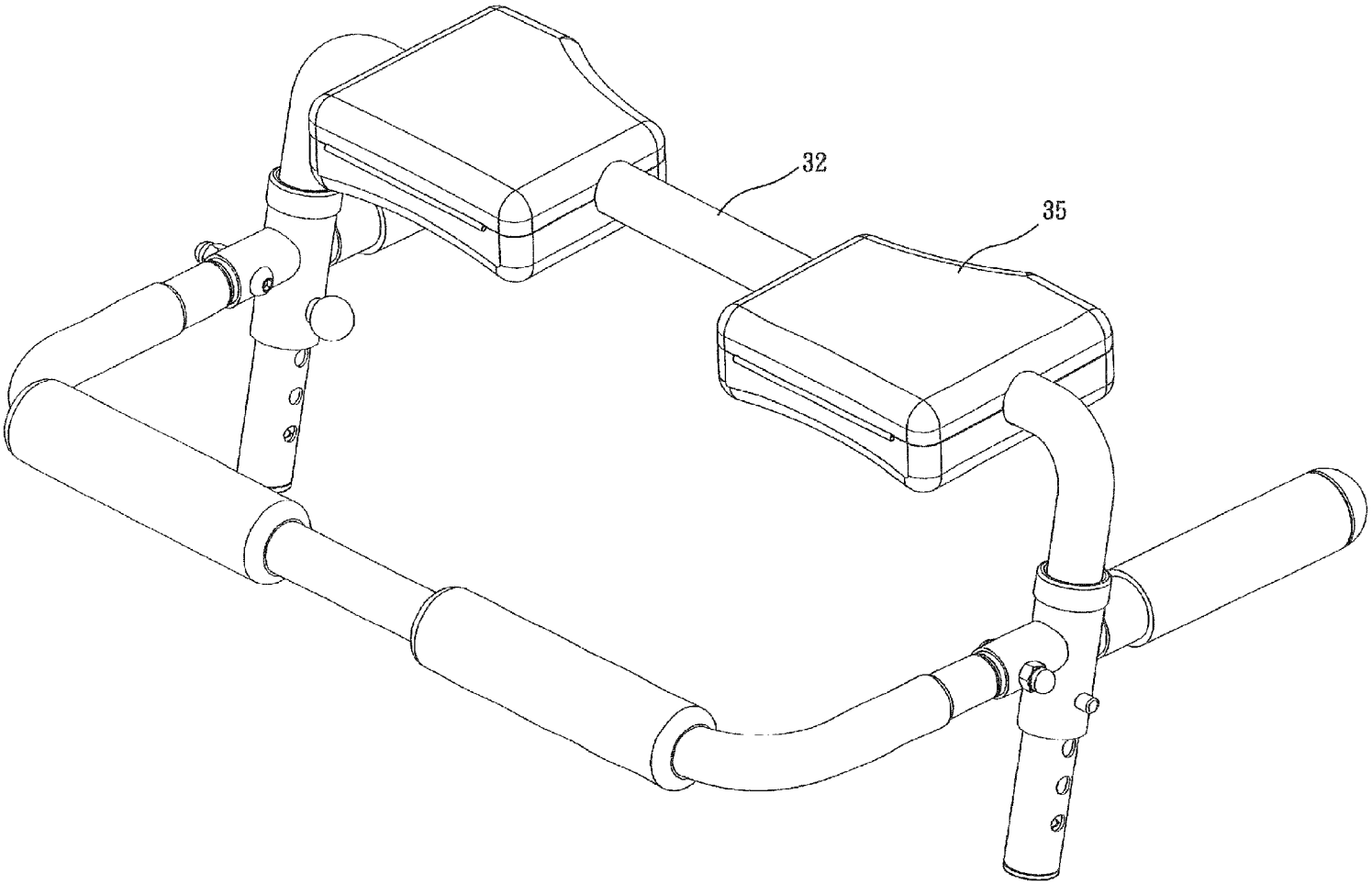
FIGS. 7 and 8 show a second embodiment according to the present invention.
Figure 8:
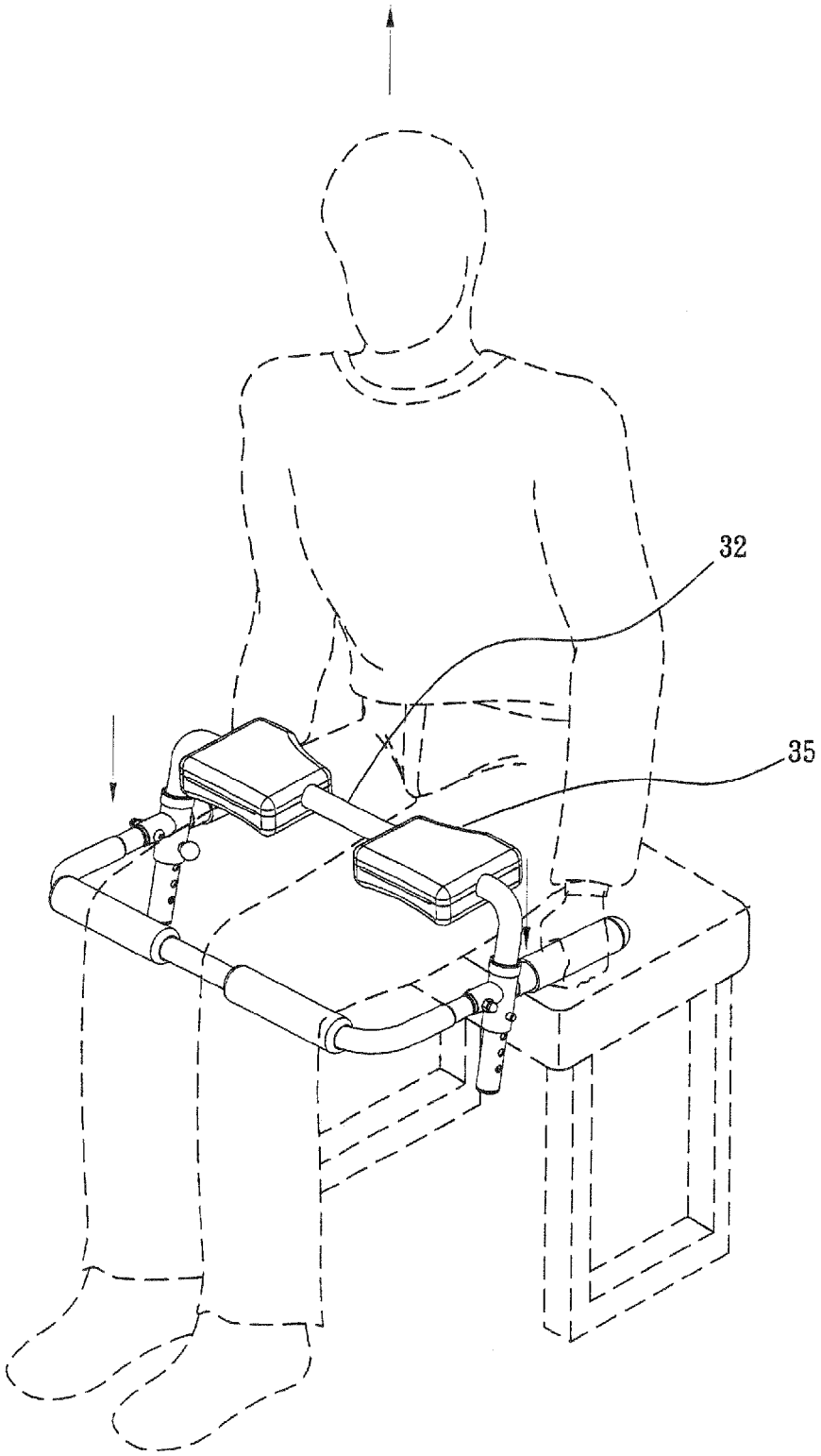

Referring to FIGS. 7 and 8, a second embodiment of the present invention is shown, wherein the pressure relief collars 34 of the previous embodiment shown in FIG. 2 are modified as two flat cushioning pads 35, which are provided on the upper cross bar 35 for holding down the user's legs. With such a modification, the contact area between the cushioning pads 35 and the legs is increased to alleviate discomfort caused by stress concentration.

The flat cushioning pads 35 provided on the upper cross bar 35 are generally flat only for surfaces parallel to the user's legs, whereas surfaces of the cushioning pads 35 that are generally perpendicular to the user's legs may be curved to fit the legs of the user. Preferably, a semi-circular or otherwise curved cutoff is formed at an inner corner of each flat cushioning pad 35 as seen in the plan view of the pad, in order to allow relief for the groin as the pad needs to be placed as high on the user's leg as possible.

Although it is not clear in the drawings that the lower cross bar 22 with the cushioning collar 23 attached thereto is put behind the knees of the user, it is necessary that the lower cross bar 22 is put behind the knees, while the upper cross bar 32 on top of the thighs.

In addition, as shown in FIG. 1 and descried above, the two U-shaped bar assemblies 20, 30 can be fully disconnected to allow for compact packing in the suitcase.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A back stretching device, comprising:

a handle unit, which has two parallel handgrip tubes, each of which has opposite front and rear ends;

a support unit, which comprises a lower cross bar connecting between the front ends of the two handgrip tubes, the lower cross bar and the handgrip tubes collectively defining a first plane;

a hold-down unit, which comprises two parallel guide rods, each of which has opposite upper and lower ends, an upper cross bar connecting between the upper ends of the guide rods, the upper cross bar being substantially parallel to the lower cross bar, the guide rods and the upper cross bar collectively defining a second plane, which intersects the first plane at a predetermined non-zero angle; and an adjustment unit, which couples the two guide rods to the two handgrip tubes in such a way that the upper cross bar is movable on the second plane with respect to the lower cross bar and is spaced from the first plane so as to define a distance-adjustable constraint space between the upper cross bar and the lower cross bar, whereby the constraint space is sufficient to receive the legs of a user to extend therethrough in a closely juxtaposed manner with the lower cross bar configured to support the underside of the legs, with the upper cross bar configured to constrain the upper side of the legs, the two handgrip tubes configured to be held by the hands of the user to support the legs and body of the user for carrying out a back stretching operation;

wherein the adjustment unit comprises two sleeves respectively mounted to the front ends of the handgrip tubes, the lower cross bar being arranged to connect between the two sleeves, the two sleeves respectively receiving the two guide rods to slide therein for coupling, the two guide rods each forming a series of adjustment holes extending therethrough at different altitudes, the sleeves each forming a positioning hole corresponding to the adjustment holes, a pin being removably fit into the positioning hole and a respective one of the adjustment holes to secure the guide rod to the respective sleeve; the support unit comprises two parallel connection bars, each of which has opposite front and rear ends, the lower cross bar being connected between the front ends of the two connection bars, the two connection bars being respectively coupled to the front ends of the two handgrip tubes through the adjustment unit; the two connection bars each form a diameter-reduced neck section at the rear end thereof, a first assembling hole being formed diametrically through the neck section, the two sleeves each comprising a joint tube extending from an outer circumference thereof for receiving the respective connection bar to insert therein, the joint tube forming a second assembling hole corresponding to the first assembling hole, whereby a fastener set is receivable through the first and second assembling holes to connect the lower cross bar between the two handgrip tubes.

2. The back stretching device according to claim 1, wherein the two sleeves each comprise an insertion tube extending from an outer circumference thereof for respectively inserting into the handgrip tubes.

3. The back stretching device according to claim 1, wherein the pin comprises a diametrically expanded pull knob formed at an end thereof projecting outside the sleeve and a ball is provided at an opposite end of the pin and is biased by a spring to project beyond a surface of the pin, whereby with a sufficient force applied, the ball is inwardly retractable for passing through the adjustment holes and the positioning hole.

4. The back stretching device according to claim 1, wherein a cushioning collar is provided to surround an outer circumference of the lower cross bar, whereby the lower cross bar is configured to support the legs with the cushioning collar.

5. The back stretching device according to claim 1, wherein a pressure relief collar is provided to surround an outer circumference of the upper cross bar, whereby the upper cross bar is configured to constrain the legs with the pressure relief collar.

6. The back stretching device according to claim 1, wherein a flat cushioning pad is provided on the upper cross bar, whereby the upper cross bar is configured to constrain the legs with the cushioning pad.

7. The back stretching device according to claim 1, wherein a cushioning collar is provided to surround an outer circumference of the lower cross bar, whereby the lower cross bar is configured to support the legs with the cushioning collar.

8. The back stretching device according to claim 1, wherein a pressure relief collar is provided to surround an outer circumference of the upper cross bar, whereby the upper cross bar is configured to constrain the legs with the pressure relief collar.

9. The back stretching device according to claim 1, wherein a flat cushioning pad is provided on the upper cross bar, whereby the upper cross bar is configured to constrain the legs with the cushioning pad.

* * * * *